US008986049B2

(12) United States Patent
Kamarauskas et al.

(10) Patent No.: US 8,986,049 B2
(45) Date of Patent: Mar. 24, 2015

(54) ELECTRICAL CONNECTOR

(75) Inventors: Michael R. Kamarauskas, Bartlett, IL (US); Nagesh Kestur Nagarajan, Singapore (SG); Jessie Chua, Singapore (SG)

(73) Assignee: Molex Incorporated, Lisle, IL (US)

( * ) Notice: Subject to any disclaimer, the term of this patent is extended or adjusted under 35 U.S.C. 154(b) by 352 days.

(21) Appl. No.: 13/637,380

(22) PCT Filed: Mar. 29, 2011

(86) PCT No.: PCT/US2011/030330

§ 371 (c)(1),
(2), (4) Date: May 23, 2013

(87) PCT Pub. No.: WO2011/126838

PCT Pub. Date: Oct. 13, 2011

(65) Prior Publication Data

US 2013/0237093 A1 Sep. 12, 2013

(30) Foreign Application Priority Data

Mar. 29, 2010 (CN) ..... 2010 2 0160159 U

(51) Int. Cl.

| | |
|---|---|
| ***H01R 33/00*** | (2006.01) |
| ***H01R 13/648*** | (2006.01) |
| ***H01R 13/24*** | (2006.01) |
| ***H01R 13/506*** | (2006.01) |
| *H01R 13/6581* | (2011.01) |

(52) U.S. Cl.

CPC ..... *H01R 13/648* (2013.01); *H01R 13/2442* (2013.01); *H01R 13/506* (2013.01); *H01R 13/6581* (2013.01)

USPC ..... 439/660; 439/607.41

(58) Field of Classification Search

USPC ..... 439/660, 607.41

See application file for complete search history.

(56) References Cited

U.S. PATENT DOCUMENTS

| | | | | |
|---|---|---|---|---|
| 4,916,804 | A | 4/1990 | Yoshimura et al. | |
| 5,785,557 | A * | 7/1998 | Davis | 439/660 |
| 6,083,051 | A * | 7/2000 | Chang | 439/660 |
| 6,234,827 | B1 | 5/2001 | Nishio et al. | |
| 8,740,652 | B2 * | 6/2014 | Hsueh | 439/660 |
| 2006/0134983 | A1 * | 6/2006 | Wang et al. | 439/607 |
| 2010/0136806 | A1 | 6/2010 | Chen et al. | |
| 2011/0195601 | A1 * | 8/2011 | Chen et al. | 439/607.01 |
| 2011/0281468 | A1 * | 11/2011 | Yu et al. | 439/660 |
| 2011/0294354 | A1 * | 12/2011 | Chen et al. | 439/660 |
| 2012/0052709 | A1 * | 3/2012 | Ko | 439/345 |
| 2013/0143447 | A1 * | 6/2013 | He et al. | 439/660 |
| 2013/0210284 | A1 * | 8/2013 | Wang et al. | 439/660 |

FOREIGN PATENT DOCUMENTS

| | | |
|---|---|---|
| EP | 2 104 185 A1 | 9/2009 |
| JP | 2009-076454 | 4/2009 |
| TW | 94212910 | 12/2005 |

* cited by examiner

*Primary Examiner* — Gary Paumen
(74) *Attorney, Agent, or Firm* — Stephen L. Sheldon

(57) ABSTRACT

An electrical connector includes an insulator body, a number of terminals arranged on the insulator body, and a shell surrounding the insulator body. The insulator body comprises a main body and a mating portion extending forward from the main body, the front end of the mating portion has a mating aperture, and the top and bottom sides of the mating aperture have a number of terminal grooves. Each terminal includes an elastic portion, a contact portion extending from the elastic portion, and an abutting portion located at the end of the contact portion. The terminals can be configured as to become gradually thinner toward the abutting portion.

10 Claims, 11 Drawing Sheets

ELECTRICAL CONNECTOR

RELATED APPLICATIONS

The application is a national phase of PCT Application No. PCT/US11/30330, filed Mar. 29, 2011, which in turn claims priority to Chinese Patent Application No. 201020160159.7, filed Mar. 29, 2010, both of which are incorporated herein by reference in their entirety.

FIELD OF THE INVENTION

The present application relates to an electrical connector, more specifically to a small electrical connector that can beneficially increase the stability of an electrical connection.

DESCRIPTION OF RELATED ART

With the development of electrical and information technologies, more and more standardized electrical connectors are being developed and utilized. Looking at Taiwanese patent TW94212910 as an example, it discloses a connector 7 as shown in FIG. 1 that is suitable for use in transferring digital audio-video data. The connector 7 consists of a plastic upper lip 70, an upper layer plastic tongue 71, a lower layer plastic tongue 72, a plastic lower lip 73, a metal outer shell 74, and metal pins 75. Of these, the plastic upper lip 70, upper layer plastic tongue 71, lower layer plastic tongue 72, and plastic lower lip 73 are stacked together from top to bottom to form a stacked body. Then it is encased by the metal outer shell 74 from the front of the stacked body, and together they form the connector 7. As shown in FIG. 2, the majority of the metal pins 75 are contained within the upper layer plastic tongue 71 and lower layer plastic tongue 72, wherein the contact portion 750 of the metal pins 75 contained within the upper layer plastic tongue 71 has a ∪ shape, and the contact portion 750 of the metal pins 75 contained within the lower layer plastic tongue 72 has a ∩ shape; the front ends 751 of the corresponding metal pins 75 are fastened inside the channels 700 of the plastic upper lip 70 and the plastic lower lip 73, respectively, in order to prevent the terminals from sticking up inappropriately, which could result in damage during mating.

As can be appreciated, therefore, when the electrical connector 7 is mated to the inserted connector socket 8, the contact portion 750 of the metal pins 75 relies only upon the elastic deformation of its own material to contact the surface of the inserted connector socket 8. After a long period of use or multiple insertions and removals, the contact portion 750, as it is susceptible to non-elastic deformation (e.g., the terminals taking a permanent set) due to excessive force during insertion and removal or due to elastic fatigue, it can be difficult to tightly mate the electrical connector 7 to the inserted connector socket 8. Thus the stability of the electrical connection and the quality of signal transmission may be impacted. In addition, because the electrical connector 7 requires that sufficient deformation space (a ∪ shaped or ∩ shaped space) is left for the metal pins 75 inside the plastic stacked body, the connector 7 is quite thick, making it difficult to adapt to the trend of miniaturization in electronic products. In addition, its plastic body consists of two portions, a plastic upper lip 70 and a plastic lower lip 73, which tend to make assembly more difficult. Consequentially, further improvements to a connector would be appreciated by certain individuals.

BRIEF SUMMARY

An electrical connector, comprising at least an insulator body, a number of terminals arranged on the insulator body, and a shell surrounding the insulator body. The insulator body comprises a main body and a mating portion extending forward from the main body, wherein the mating portion has a front end with a mating opening, and the top and bottom sides of the mating opening have a number of terminal channels. The terminal can be cantilevered so that an elastic portion extending forward from a base and an arched contact portion extends from the elastic portion and an abutting portion extends from the contact portion. In an embodiment, a single housing can be configured to receive a first and second frame that each support terminals respectively positioned on the top and bottom sides of the mating opening. Starting from the junction of the elastic portion and the contact portion, the thickness of the terminals can be configured to gradually thin toward the abutting portion.

BRIEF DESCRIPTION OF THE FIGURES

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

As can be appreciated by the details described below, in the depicted an embodiment of the depicted electrical connector, the contact portion of the terminals can experience elastic movement within the terminal grooves, and it does not rely solely upon the elastic deformation of its own material as in prior art. Therefore, it is possible to maintain tight contact with another socket connector after a long period of use and thus avoid poor contact between mating terminals. As a result, the electrical connector has relatively higher operating stability and a fairly long life. In addition, by thinning the abutting portion of the terminals, it is possible to increase the gap between the abutting portion and the shell while ensuring that the thickness of the elastic portion gives it fairly strong elasticity, thus guarding against mistaken contact between the abutting portion and the shell during mating which would lead to signal transmission failure.

Figure 1:
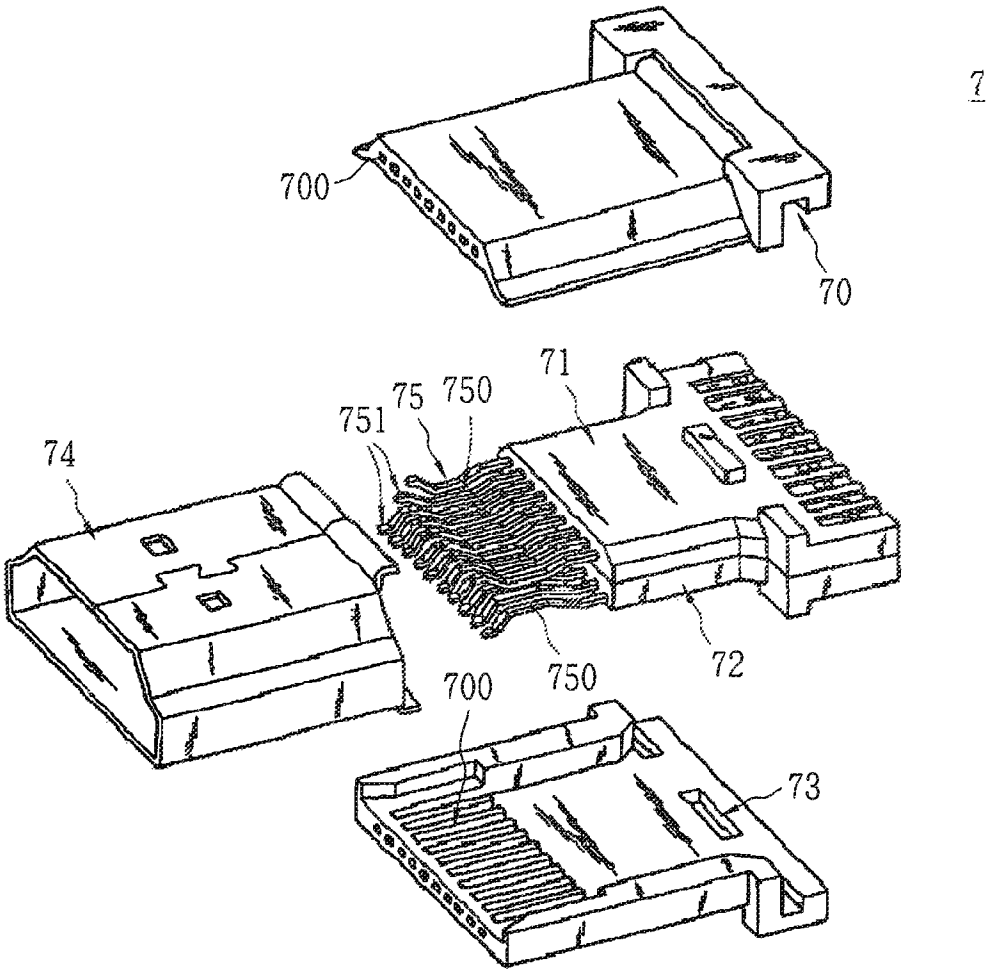
FIG. 1 Prior Art
FIG. 1 is a perspective exploded view of a prior art electrical connector.
Figure 2:
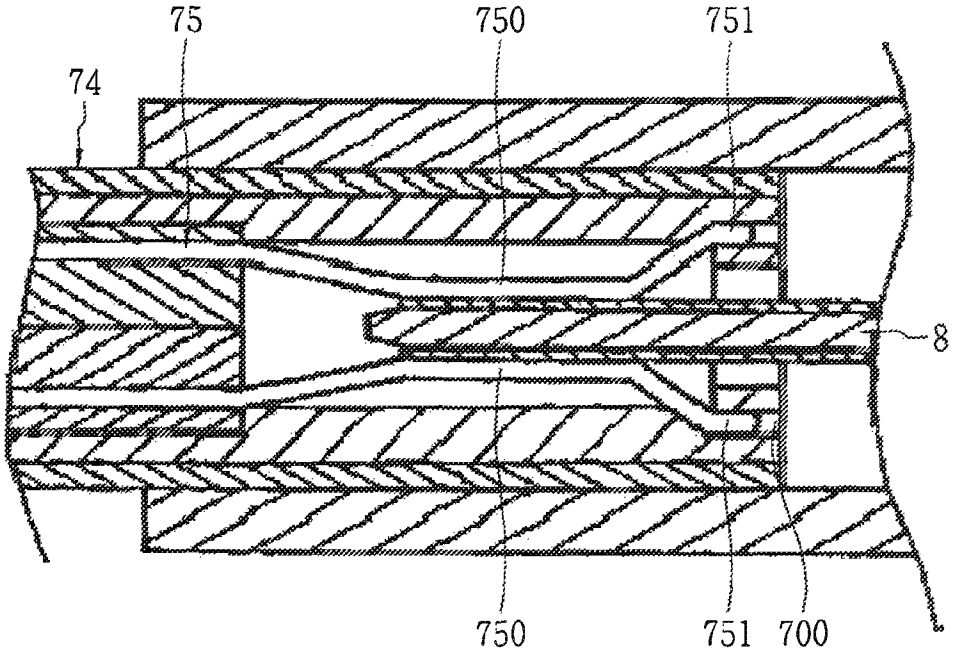
FIG. 2 Prior Art
FIG. 2 is a sectional view of a prior electrical connector during mating.
Figure 3:
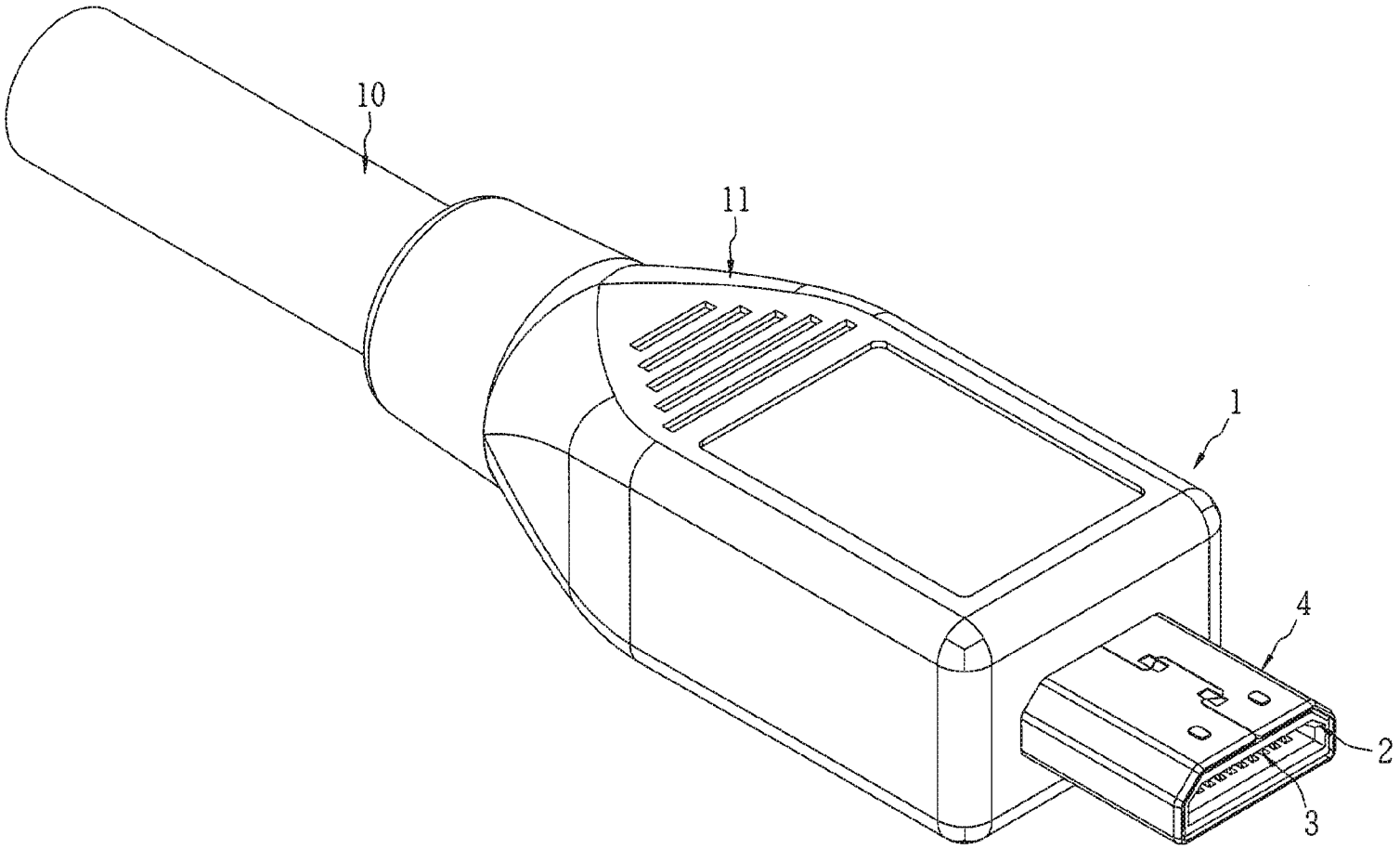
FIG. 3 is a perspective view of an embodiment of an electrical connector and it also includes a cable and a protective casing.

FIG. 3 is a perspective view of the electrical connector 1 of an embodiment. As depicted in FIG. 3, the electrical connector 1 is a micro high-definition multimedia interface D-type cable connector. The electrical connector 1 comprises an insulator body 2, a number of terminals 3 supported by the insulator body 2, and a shell 4 surrounding the insulator body 2. The electrical connector 1 is further set up with a cable 10 that is electrically connected to the terminals 3 and a protective casing 11.

Figure 4:
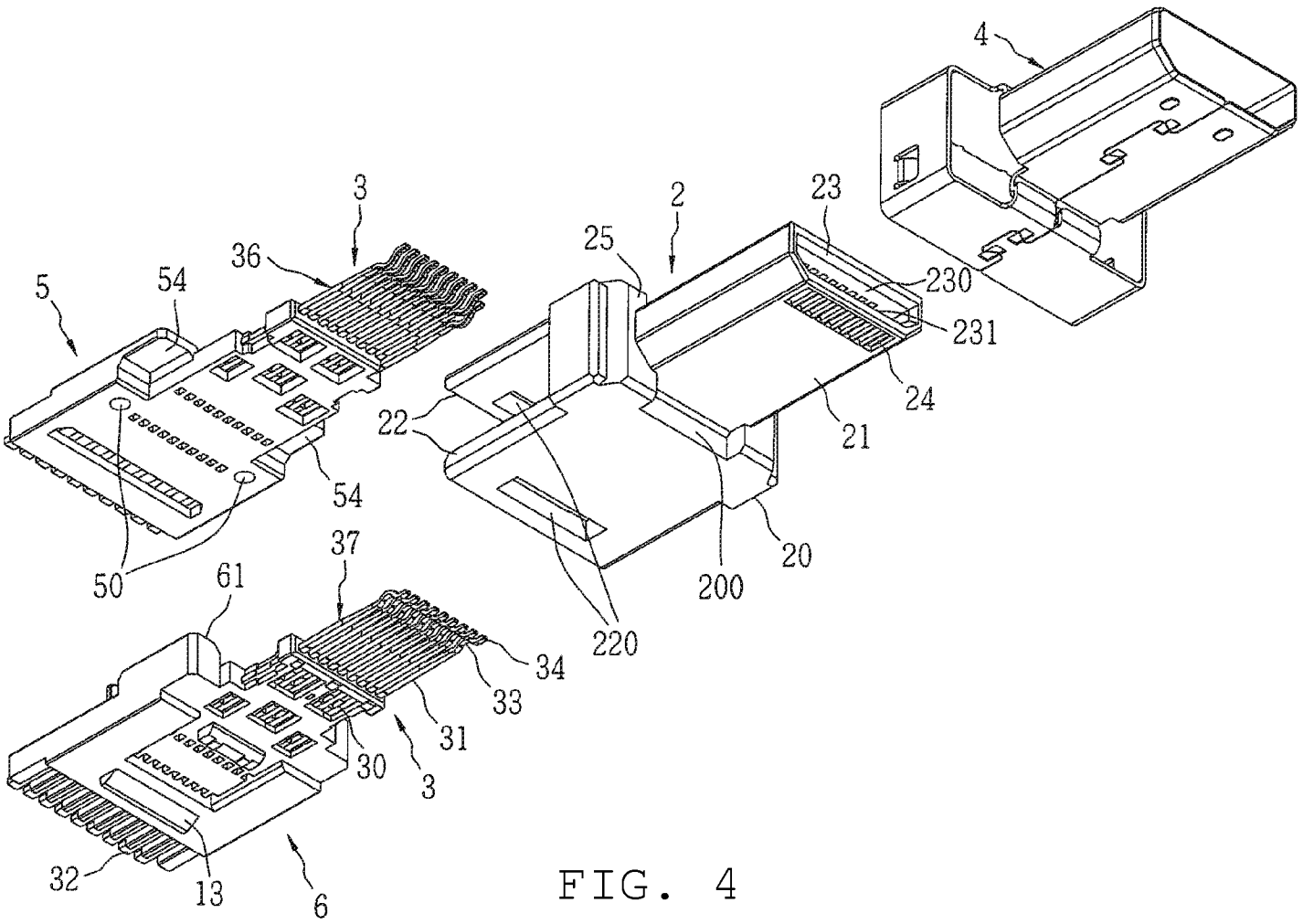
FIG. 4 is a perspective exploded view of the electrical connector depicted in FIG. 3.
Figure 5:
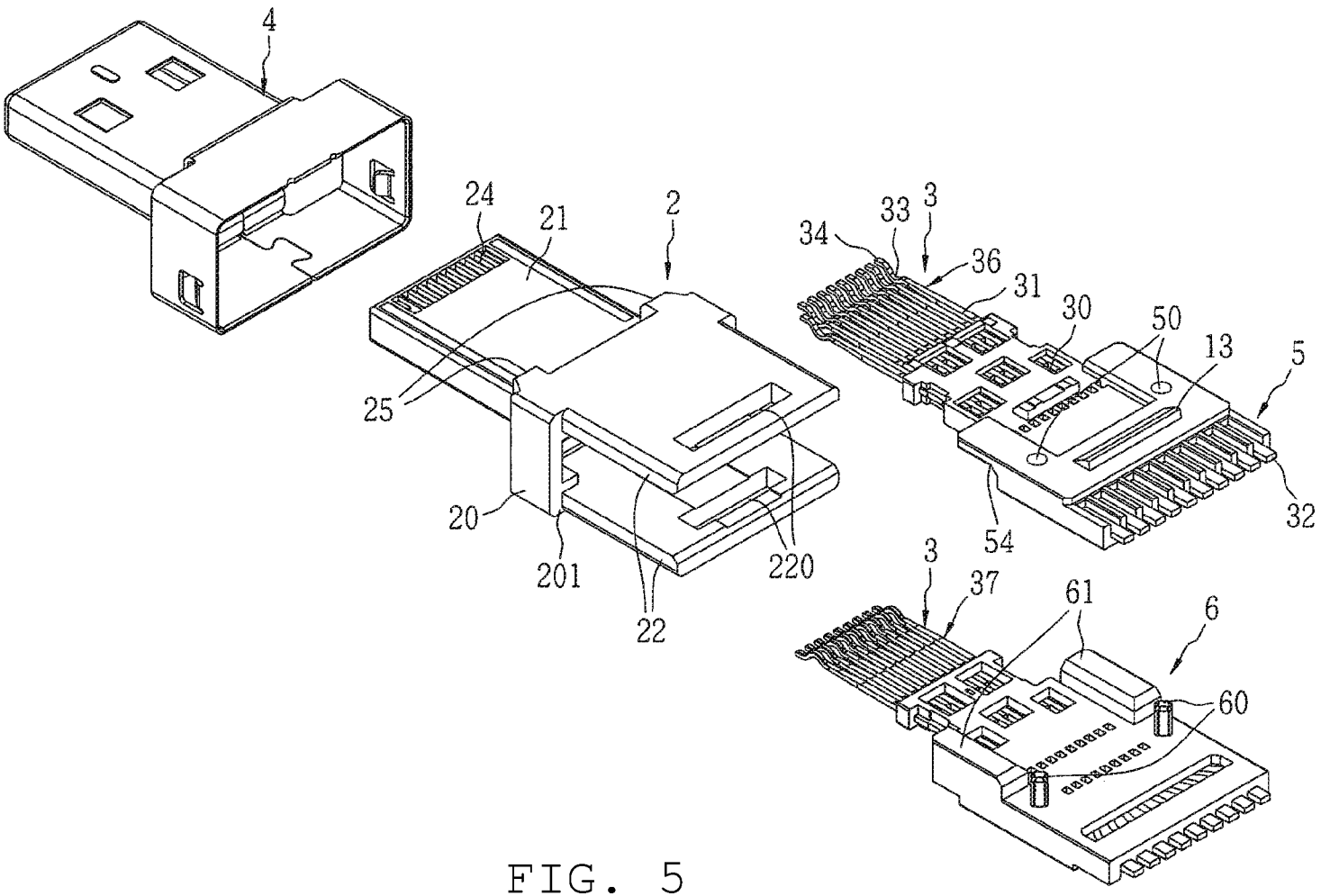
FIG. 5 is another perspective exploded view of the electrical connector depicted in FIG. 3.
Figure 6:
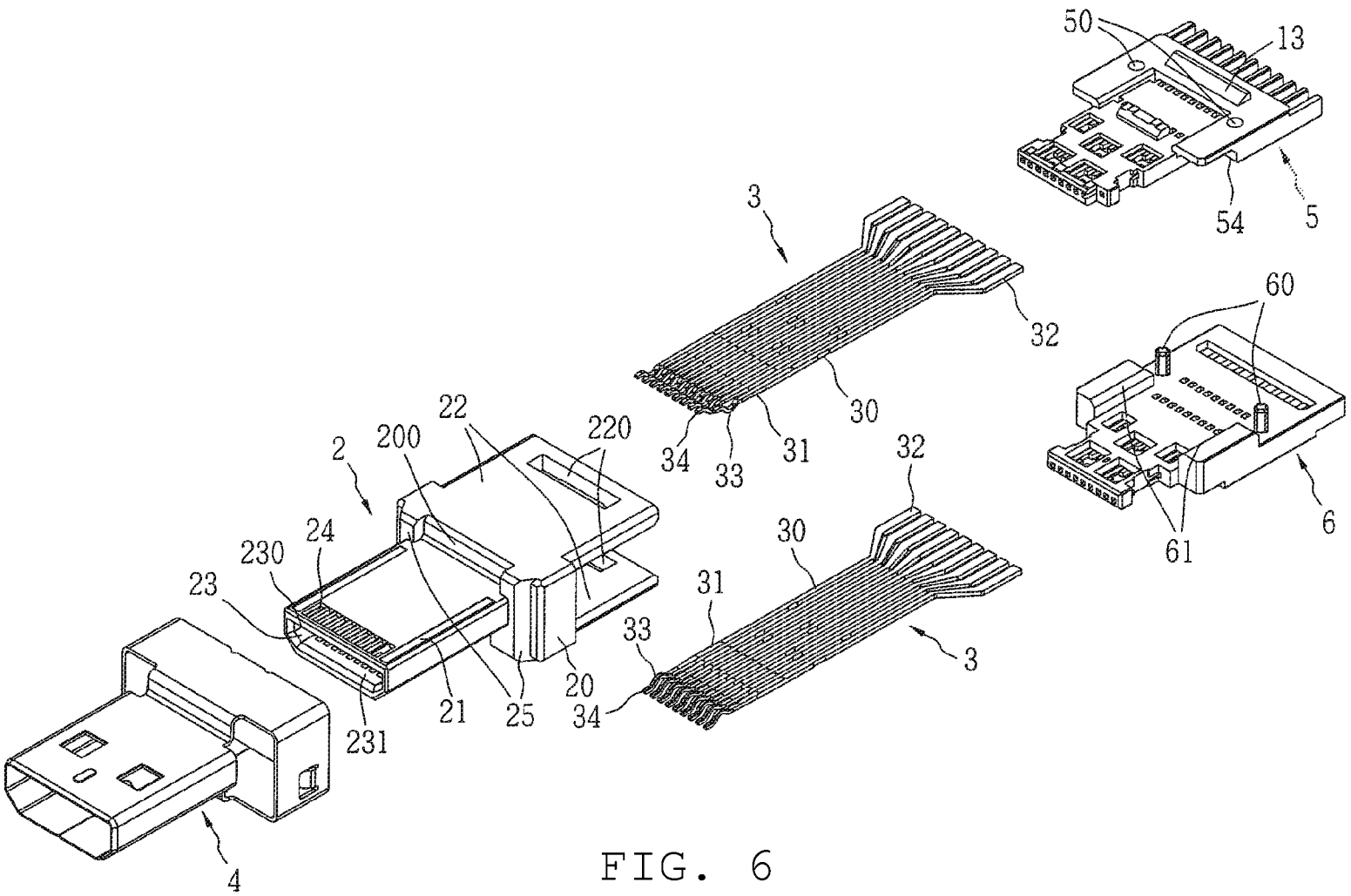
FIG. 6 is another perspective exploded view of the electrical connector depicted in FIG. 3.

FIGS. 4, 5, and 6 are perspective exploded views of the embodiment of the electrical connector 1. As shown in FIGS. 4, 5, and 6, the insulator body 2 comprises a main body 20, mating portion 21 protruding forward from the front face 200 of the main body 20, and two flanges 22 protruding from the bottom and top ends of the rear face 201 of the main body 20. The front end of the mating portion 21 has a mating aperture 23, and the top side wall 230 and bottom side wall 231 of the mating aperture 23 have a number of parallel terminal grooves 24. Each of the two flanges 22 has a fixing hole 220. In addition, the main body 20 has a reinforcement portion 25 protruding forward on each of the two sides of the mating portion 21, and the reinforcement portion 25 can boost the compressive strength of the insulator body 2.

As depicted, each terminal 3 comprises a base portion 30, an elastic portion 31 extending forward from the base portion 30, a soldering portion 32 extending backward from the base portion 30, an arched contact portion 33 extending forward from the elastic portion 31, and an abutting portion 34 located at the end of the arched contact portion 33. As is typical, the terminal is conductive and can be formed of a desired alloy such as a copper-based alloy.

In the present embodiment, the electrical connector 1 further comprises a top row frame 5 and a bottom row frame 6, thus the corresponding terminal grooves 24 on the insulator body 2 separate all of the terminals 3 into top row terminals 36 and bottom row terminals 37. The top row frame 5 and bottom row frame 6 use an insert molding system to respectively fix the corresponding top row terminals 36 and bottom row terminals 37. The soldering portions 32 of the top row terminals 36 and bottom row terminals 37 extend backward from the back end of the top row frame 5 and the bottom row frame 6, respectively. The elastic portion 31 of the top row terminals 36 and bottom row terminals 37 extends forward from a front end of the top row frame 5 and the bottom row frame 6, respectively. The top row frame 5 has a number of positioning holes 50, and the bottom row frame 6 has a number of corresponding positioning posts 60. These positioning posts 60 can be inserted correspondingly into the positioning holes 50, thus assembling the two frames together. In order to prevent slipping between the top row frame 5 and the bottom row frame 6, two steps 61 protrude from the two sides of the top surface of the bottom row frame 6, and they match up with two grooves 54 on the two sides of the bottom surface of the top row frame 5 to form an anti-slip structure. In addition, the top surface of the top row frame 5 and the bottom surface of the bottom row frame 6 each have a wedge 13 that is low in front and high in back, and each of these two wedges 13 can be fixed correspondingly inside the fixing holes 220 of the flanges 22 on the insulator body 2.

Those skilled in the art would understand that the above description should not be viewed as limiting the specific positions of the top row frame 5 and bottom row frame 6 assembly structure. Thus, relevant adjustments can be made to the two as needed in actual applications. For example, if the positioning holes 50 are on the bottom row frame 6, then the matching positioning posts 60 will be on the top row frame 5.

Figure 7:
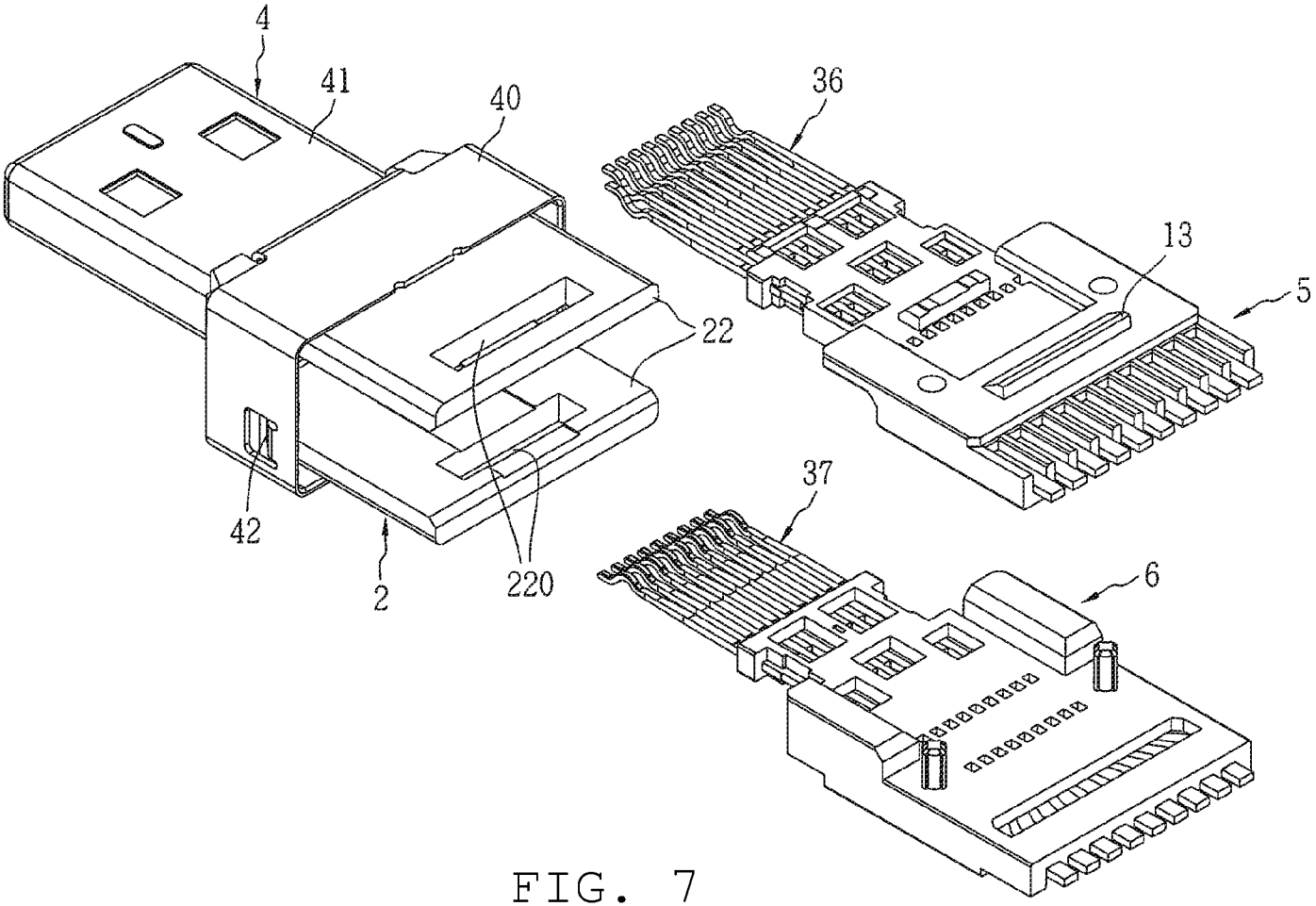
FIG. 7 is another perspective exploded view of the electrical connector depicted in FIG. 3.

FIG. 7 is a perspective exploded view of an embodiment of an electrical connector 1. As shown, the shell 4, which helps providing shielding, primarily surrounds the outside of the main body 20 and mating portion 21 of the insulator body 2. The shell 4 has a main shell 40 and a mating shell 41 corresponding to the main body 20 and mating portion 21, and the left and right sides of the main shell 40 each have a protruding portion 42 protruding inward.

Figure 8:
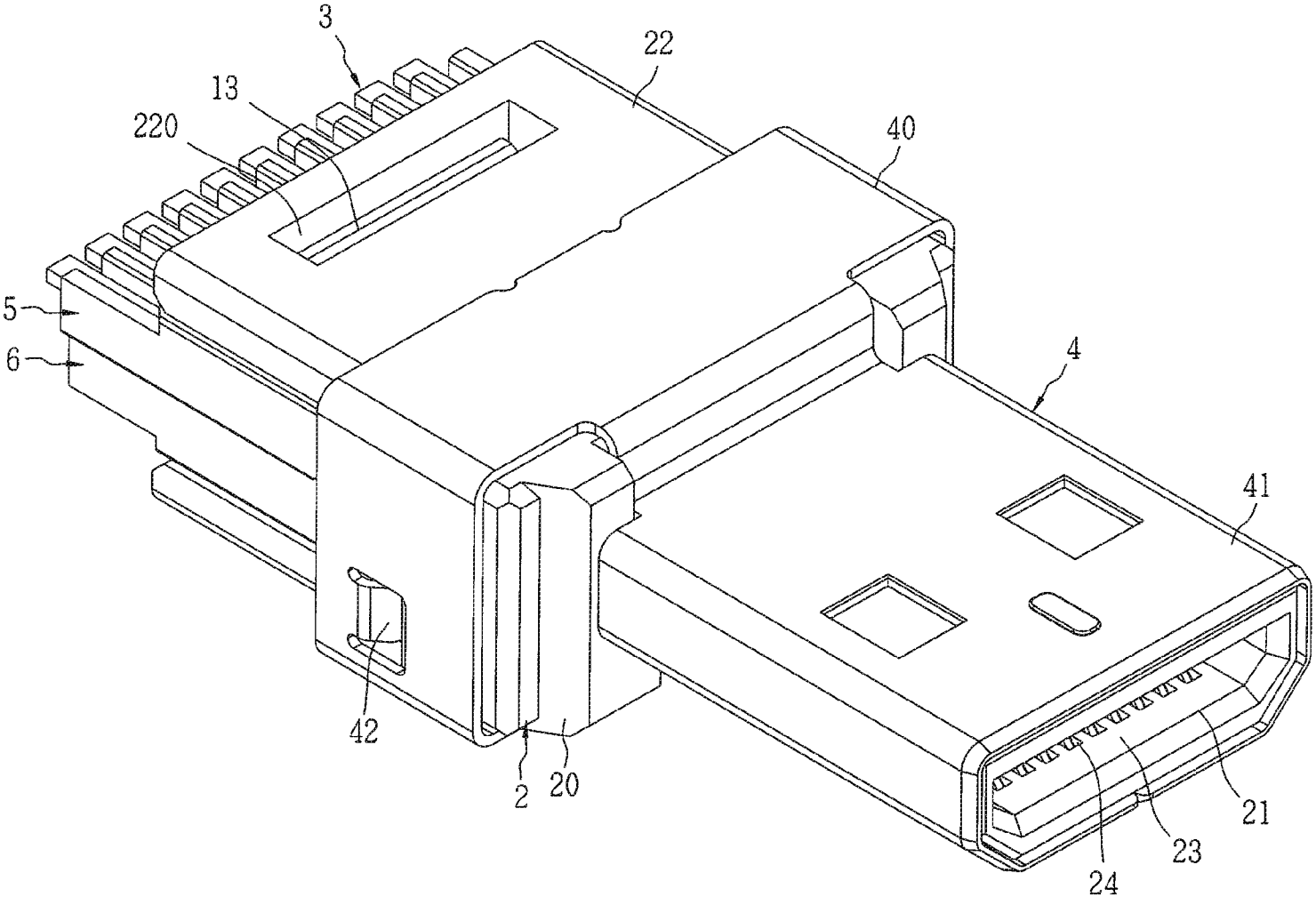
FIG. 8 is a perspective view of the electrical connector depicted in FIG. 3 without the protective casing.
Figure 10:
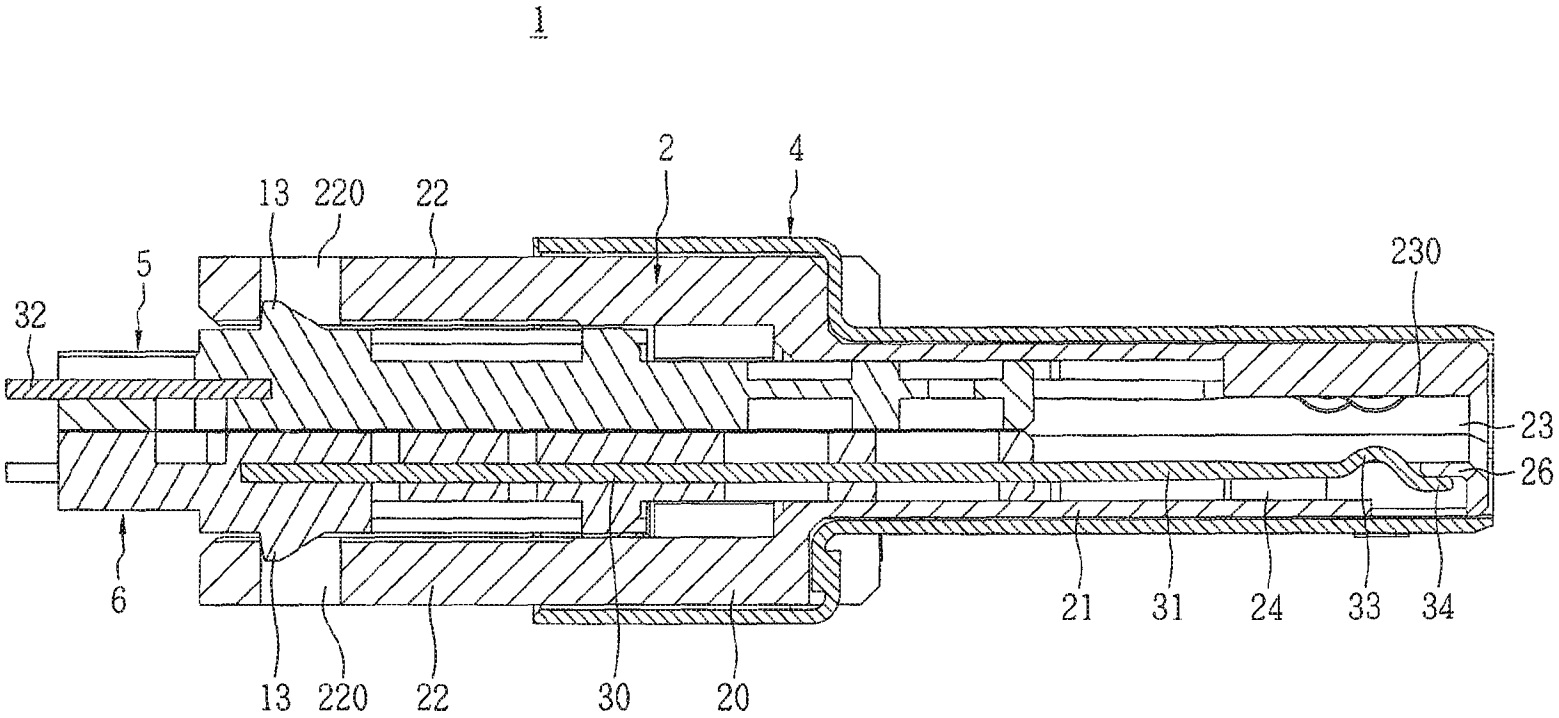
FIG. 10 is an elevated side view of a section taken along line A-A in FIG. 9.

During assembly, the top row frame 5 is first assembled with the bottom row frame 6, then they are inserted forward between the two flanges 22 of the insulator body 2. The wedges 13 of the top row frame 5 and the bottom row frame 6, designed to be low in front and high in back, can facilitate the insertion process, and after assembly they are wedged inside the corresponding fixing holes 220 (as shown in FIGS. 8 and 10), thus stopping the top row frame 5 and bottom row frame 6 inside the insulator body 2 and making it impossible for them to come back out. The assembly structure is simple and reliable. The shell 4 can be assembled onto the insulator body 2 from front to back. As shown in FIG. 8, the protruding portions 42 on either side can be bent further inward, wedging them onto the rear face 201 of the insulator body 2, in order to strength the combination of the shell 4 and the insulator body 2 and making sure the two do not come apart.

Figure 9:
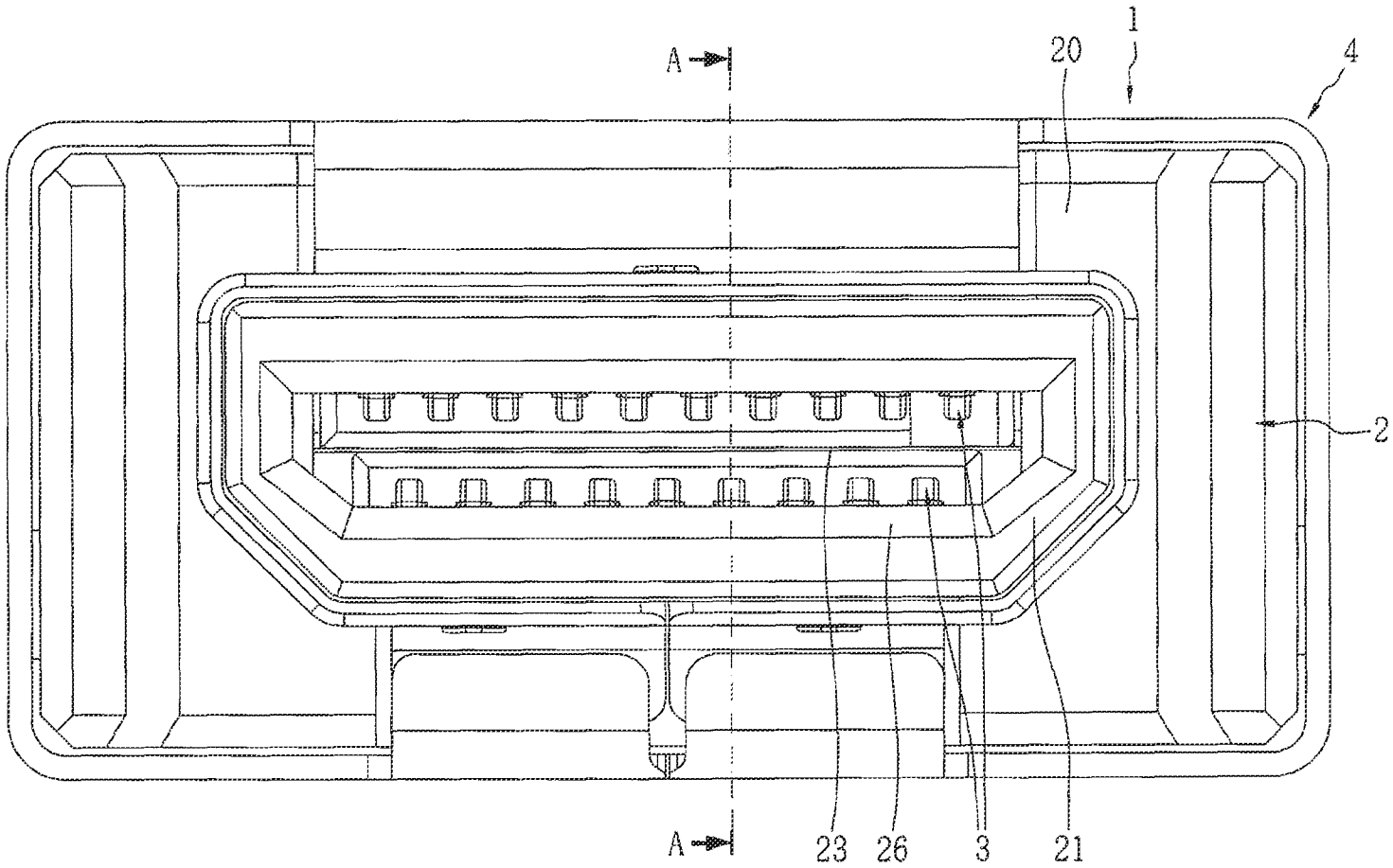
FIG. 9 is an elevated front view of the connector depicted in FIG. 8.

As shown in FIGS. 9 and 10, the elastic portion 31, contact portion 33, and abutting portion 34 of each terminal 3 are contained with the corresponding terminal grooves 24 on the insulator body 2, and the top end of the contact portion 33 protrudes into the mating space of the mating aperture 23. As depicted, the part of the front end of each terminal groove 24 that is at the corresponding terminal's 3 abutting portion 34 runs up and down along one side of the insulator body's 2 mating portion 21, thus making it possible to link up with the shell 4. The front end of the mating portion 21 of the insulator body 2 has an abutting wall 26 extending between the mating aperture 23 and terminal grooves 24. The abutting portion 34 of the terminals 3 can butt up against the lower part of the abutting wall 26, thus stopping the front end of the terminals 3 and avoiding having the contact portion 33 and abutting portion 34 of the terminals 3 stick up too much and enter the mating aperture 23. Furthermore, it avoids bending damage from having the front end of the terminals 3 knock against another socket connector during mating (not pictured).

In addition, when the electrical connector of the present embodiment is not mated to another socket connector, because the elastic portion 31 of the terminals 3 already experienced a small amount of elastic deformation when being assembled onto the insulator body 2, the abutting portion 34 exerts preloaded elastic compression on the abutting wall 26. Thus, when it is mated to another socket connector, the contact portion 33 only needs to move down a small distance to make it possible to achieve considerable elastic recovery force, thus lowering the contact resistance between the contact portion 33 and the terminals of the mated socket connector and helping to improve signal quality.

Figure 11:
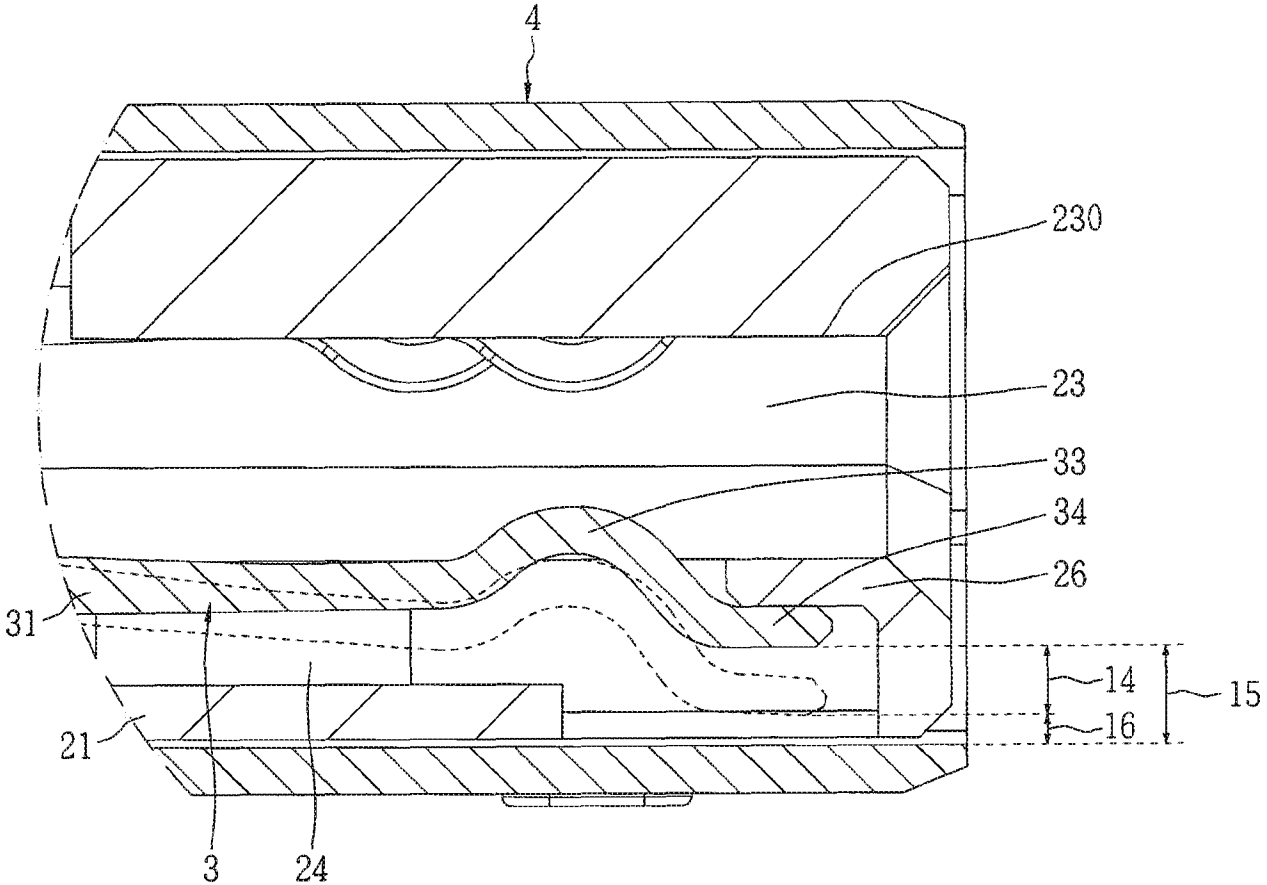
FIG. 11 is an enlarged partial view of section depicted in FIG. 10.

There is a space for movement that is greater than the thickness of the abutting portion 34 in the terminal grooves 24 between the abutting wall 36 of the insulator body 2 and the shell 4 below it, thus enabling the abutting portion 34 to elastically move up and down within it. However, in order to guard against the possibility of contact between the abutting portion 34 and the shell 4 during mating, and to avoid mistaken grounding (which would lead to a failure in signal transmission), it is useful to have a gap 15 between the abutting portion 34 and the shell 4 that is larger than the elastic displacement 14 of the abutting portion 34 during mating, even if a given gap 16 is maintained between the abutting portion 34 and the shell 4 when the electrical connector 1 is mated to another socket connector (the position of the terminals 3 in FIG. 11 is shown by a dotted line).

Taking into consideration the further miniaturization of electrical connectors 1 and to help prevent the abutting portion 34 from contacting the shell 4, in an embodiment a stamping process can be used to gradually thin the thickness of these terminals 3, starting from the junction of the elastic portion 31 and the contact portion 33, as it moves toward the abutting portion 34. The gradual thinning of the terminal thus helps increase the width of the gap 16. In an embodiment, for example, the thickness of the elastic portion 31 is about 0.20 mm, the thickness of the contact portion 33 is about 0.15 mm, and the thickness of the abutting portion 34 is about 0.12 mm. Thus, the thickness of the abutting portion can be reduced so that the thickness of the abutting portion is less than 70% of the elastic portion (e.g., 0.12/0.20=60%). In this way, it is possible to increase the gap 16 between the abutting portion 34 and the shell 4 during mating so as to help prevent the abutting portion 34 from inappropriately contacting the shell 4 during mating (even if the size of the connector is kept small) as grounding the terminal to the shield could lead to signal transmission failure.

Compared to prior electrical connectors, the front end of the terminal grooves 24 runs up and down one side of the mating portion 21, using the thickness of the original mating portion's 21 side walls to provide space for upward and downward elastic displacement of the terminals 3 during mating, thus reducing the thickness of the mating portion 21 of the electrical connector 1. At the same time, FIG. 11 illustrates support from the design of the abutting wall 26 such that the front end of the terminals 3 is held in a partially flexed position so that it cannot enter too far into the mating grove 23 and cause collision damage with the other socket connector during mating. In addition, because the contact portion 33 of the terminals 3 can move up and down to a certain extent, sufficient elastic deformation support can be obtained from other portions such as the elastic portion 31 (e.g., the stress exerted on the terminal need not cause plastic deformation), and it no longer relies solely upon the elasticity of the material at the contact portion 33 itself.

As a result, the contact portion 33 of the terminals 3 is less susceptible to elastic fatigue (e.g., less likely to take a set), and the negative effects on the terminals 3 due to excessive force or stress being placed on the contact portion 33 during insertion and removal can be reduced. Consequentially, it is possible to avoid a poor connection when the electrical connector 1 is mated to a second socket connector after a long period of use with a first socket connector. In addition, in order to further reduce the thickness of the mating portion 21 of the electrical connector 1, the front end of the terminals 3 can be thinned accordingly. As can be appreciated, this can help avoid inadvertent contact and grounding to the shield shell 4 during mating (as grounding of signal contacts would tend to create signal transmission failure).

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. An electrical connector, comprising:

at least one insulator body, the insulator body comprises a main body and a mating portion extending forward from the main body, the mating portion including a front end with a mating aperture, the mating aperture having a top and a bottom side and each of the sides includes a number of terminal grooves that extend vertically through the sides, each ending in an abutting wall that extends between the front end and the terminal groove;

a plurality of terminals supported by the insulator body and arranged in two rows and positioned partially in the terminal grooves, each terminal comprising a base portion, a soldering portion extending backward from the base portion, an elastic portion extending forward from the base portion, an arched contact portion extending forward from the elastic portion, and an abutting portion located at a forward end of the arched contact portion; and a shell surrounding the insulator body, wherein the mating aperture is in communication with the shield via the terminal grooves and wherein the abutting portion of the terminals is elastically supported in the respective terminal grooves between the abutting wall and the shell.

2. The electrical connector of claim 1, wherein the abutting portion has a first thickness and the elastic portion has a second thickness greater than the first thickness.

3. The electrical connector of claim 2, further comprising a top row frame and a bottom row frame; wherein the terminals are fixed within the top row frame and the bottom row frame.

4. The electrical connector of claim 3, wherein one of the top row frame and the bottom row frame has a number of positioning holes and the other has a number of corresponding positioning posts, the positioning posts configured to be inserted into the positioning holes.

5. The electrical connector of claim 3, wherein one of the top row frame and the bottom row frame has a number of protruding steps and the other has a number of grooves that are aligned with the steps so as to form an anti-slip structure.

6. The electrical connector of claim 1, wherein the insulator body further comprises two flanges extending backward from the main body; each flange having a fixing hole; the electrical connector further including a top row frame and a bottom row frame contained within these two flanges, the upper surface of the top row frame and the bottom surface of the bottom row frame each have a wedge that is lower in front and higher in back, wherein the wedges are contained correspondingly within the fixing holes of these two flanges.

7. The electrical connector of claim 1, wherein the main body of the insulator has a reinforcement portion protruding forward on each of the two sides of the mating portion.

8. The electrical connector of claim 1, wherein the shell has a main shell and mating shell corresponding to the main body and mating portion of the insulator body, and the main shell has at least two protruding portions protruding inward; wherein the protruding portions are bent and fastened to the main body.

9. An electrical connector of claim 1, wherein starting from the junction of the elastic portion and the contact portion the thickness of the terminals is gradually reduced from a first thickness to a second thickness as the abutting portion.

10. An electrical connector of claims 9, wherein the abutting portion of the terminals is configured to exert a preloaded force against the abutting wall of the insulator body prior to being engaged by a mating connector.

* * * * *